United States Patent [19]

Shimizu

[11] Patent Number: 4,729,780

[45] Date of Patent: Mar. 8, 1988

[54] CENTRIFUGAL CASTING DEVICE

[75] Inventor: Toshio Shimizu, Kyoto, Japan

[73] Assignees: Kabushiki Kaisha Denken; Kyocera Corporation, both of Kyoto, Japan

[21] Appl. No.: 913,707

[22] Filed: Sep. 29, 1986

[30] Foreign Application Priority Data

Sep. 30, 1985 [JP] Japan ..... 60-218266
Sep. 30, 1985 [JP] Japan ..... 60-218267

[51] Int. Cl.[4] ..... C03B 3/00

[52] U.S. Cl. ..... 65/302; 65/71; 164/114; 164/287; 164/289

[58] Field of Search ..... 65/71, 302; 164/287, 164/289, 114

[56] References Cited

U.S. PATENT DOCUMENTS 1,782,898 11/1930 Hunter et al. ..... 164/289
2,104,380 1/1938 Touceda ..... 164/287 X
2,637,079 5/1953 Kemppe ..... 164/287 X
3,625,276 12/1971 Considine et al. ..... 164/114 X

*Primary Examiner*—Arthur Kellogg

*Attorney, Agent, or Firm*—Spensley Horn Jubas & Lubitz

[57] ABSTRACT

A centrifugal casting device adapted to mold and cast a casting material melted by a casting material melting means, by the centrifugal force of a rotary arm, in a mold disposed on the centrifugal side of the arm through a casting crucible disposed at one end of the arm, in which device the melting means is designed to move outside the path of rotation of the arm at least when the arm is rotated so as to reduce the force of rotation of the arm to thereby increase efficiency of casting. And also a centrifugal casting device having the above features in which device the righting reaction of a charged compression spring is used as the driving force of the rotary arm and further included a clutch member and sensors so that the rotary arm stops as soon as possible at the end of casting and returns automatically to its normal position after stopping so as to be ready for the next step of casting and so as to automatically keep the force of rotation of the arm invariably constant.

7 Claims, 13 Drawing Figures

CENTRIFUGAL CASTING DEVICE

FIELD OF THE INVENTION

This invention relates generally to a centrifugal casting device for melt glass and similar materials, and more particularly to a device suitable for centrifugally casting an artificial dental crown and other dental members.

PRIOR ART

It is well known to use a centrifugal casting device to cast members for use in dental prosthesis and repair in which a metal material or a glass material is used. Included under the centrifugal casting device of the kind described is a device adapted to pour and cast a molten casting material into a mold connected to a casting crucible and in which the crucible is held at one end of a rotary arm, the casting material is placed in the crucible and heat melted by a torch, high frequency or arc melting and the like and the arm is rotated to pour the molten casting material into the mold placed adjacent to the crucible by centrifugal force of rotation of the arm, or a device wherein a melting furnace is installed around the crucible and adapted to be rotated along the rotary arm when molding.

Also, employed as a means for rotating the rotary arm was a means adapted to cause the arm to hold a casting crucible and a mold in contact with the crucible at one end of the arm and adapted to instantaneously rotate the arm at high speed by the stored resilience of a coil spring charged in the direction of its winding.

But of the above casting devices the former device has the disadvantage that it makes it difficult to regulate temperature, and especially in torch heating, the fact is such that the proper melting temperature of a casting material is determined by the naked eye, and also in the case of high frequency heating or arc melting, the device is enlarged in scale and temperature detection must also be dependent upon an optical means with the result that a great error in temperature measurement tended to be produced. On the other hand, the latter device not only provides a precise measuring means for temperature detection but also makes it possible to provides the device in compact form, but because a melting furnace is designed to rotate in time of casting along with the rotary arm notwithstanding the fact that the furnace is not directly related with the casting, a drive source (for example, an electric source) for rotating the furnace and the arm together requires a considerable output and because the arm is also subjected to powerful moment, the arm must be thick and strong. And also, in the case of centrifugal casting, it is desired that the rotary arm attain the required speed of rotation instantaneously after the arm starts rotation, but when the arm is equipped at its one end with such a heavy melting furnace, the arm is highly loaded, so that it is very difficult to obtain ideal initial velocity. Those were some of various problems inherent in the prior art devices.

Also, in the driving means for the rotary arm, charging of the coil spring is effected by manually rotating the arm and the charged state of the spring was maintained by an engaging pin manually drawn in and out. Accordingly, the charging of the spring tool time for preparator work before casting and was accompanied with danger. Also, because the arm rotates freely even after the end of casting, it took time before mounting and demounting of the next mold or before the step of filling a casting material into a crucible and, in addition thereto, because the rotary arm stops at any given position, the operator was not free from such a troublesome task as to restore the arm to its normal position before he could start the next step of operation. Further, there was a problem that, because the coil spring was subject to fatigue due to effect of time, charging the spring manually in the manner described above rendered it very difficult to make invariably constant the amount of charge of the spring ( which amount has a great effect on the speed of rotation of the rotary arm ) by adjusting the zero level ( horizontal position of the rotary arm). The difficulties of the kind described in connection of operation proved a serious hindrance to the automatization of the centrifugal casting device and it was strongly desired to make a drastic improvement in this respect.

SUMMARY OF THE INVENTION

A primary object of the invention is to use a melting furance capable of regulating temperatures and of reduction in size as a heating furance for melting a casting material and to reduce output of a drive source and to obtain ideal initial velocity to provide the whole of the casting device in more compact form by separating the melting furance from a rotary arm and rotating the arm alone.

Another object of the invention is directed to the fact that, in the centrifugal casting device for achieving the above object, the rotary arm is brought to a halt as soon as possible at the end of casting, returns automatically to its normal position after the halt and waits for the next casting step so as to make a series of operations automatically.

A detailed description will now be given of embodiments of the invention with reference to the accompanying drawings.

DETAILED DESCRIPTION OF THE INVENTION

Figure 1:
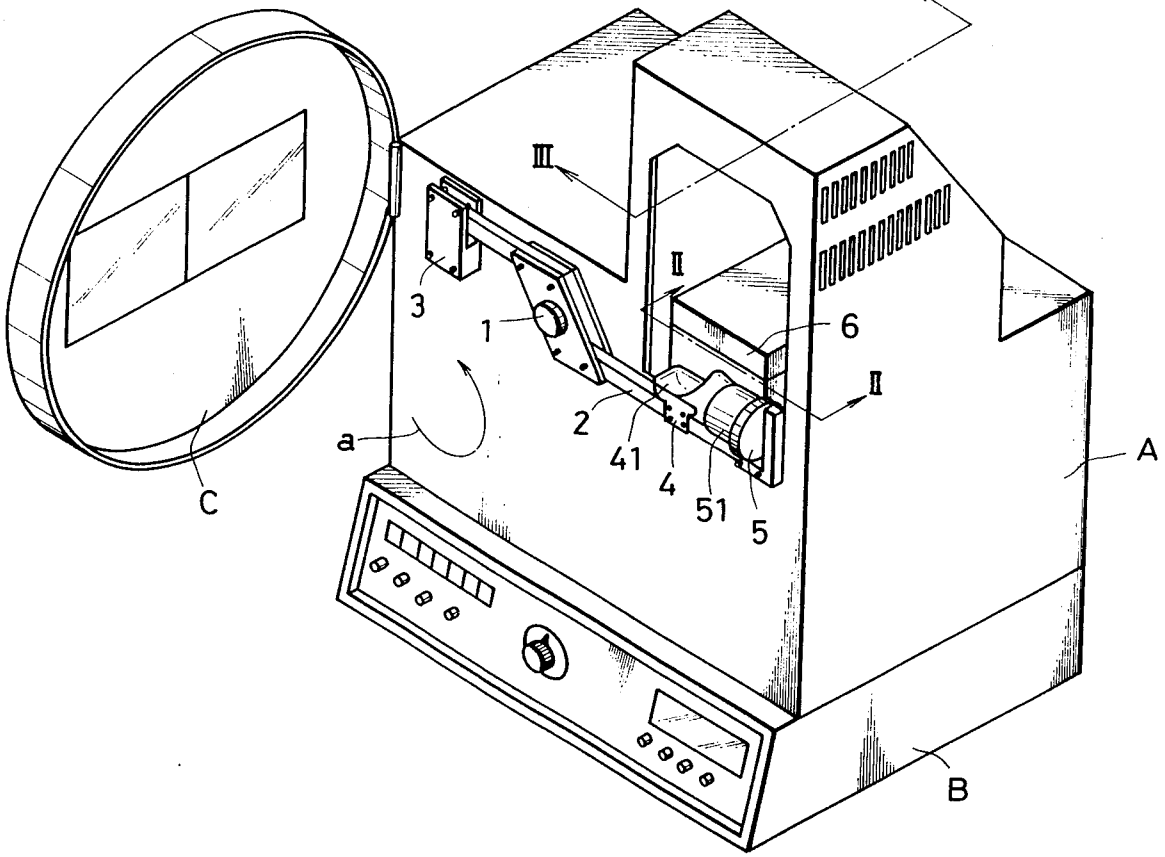
FIG. 1 is a perspective view of an embodiment of the device of the invention.
Figure 2:
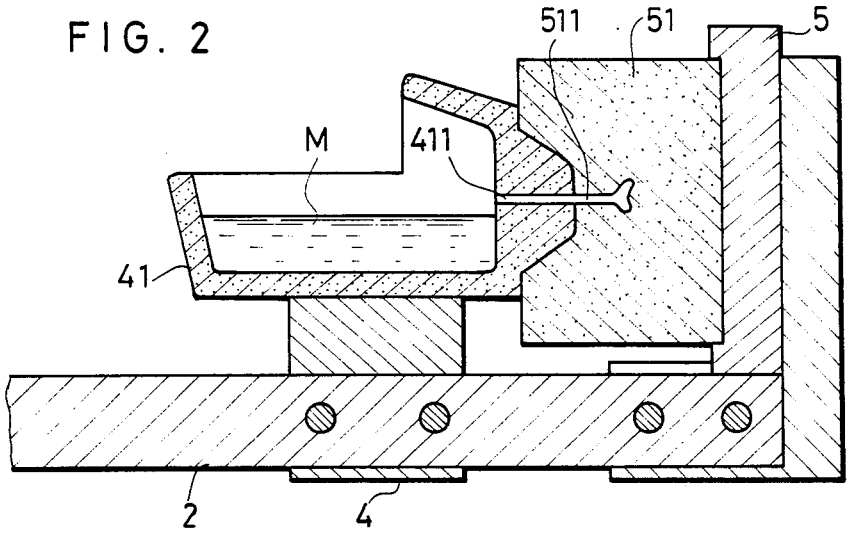
FIG. 2 is a longitudinal sectional view taken along the line II—II of FIG. 1.
Figure 3:
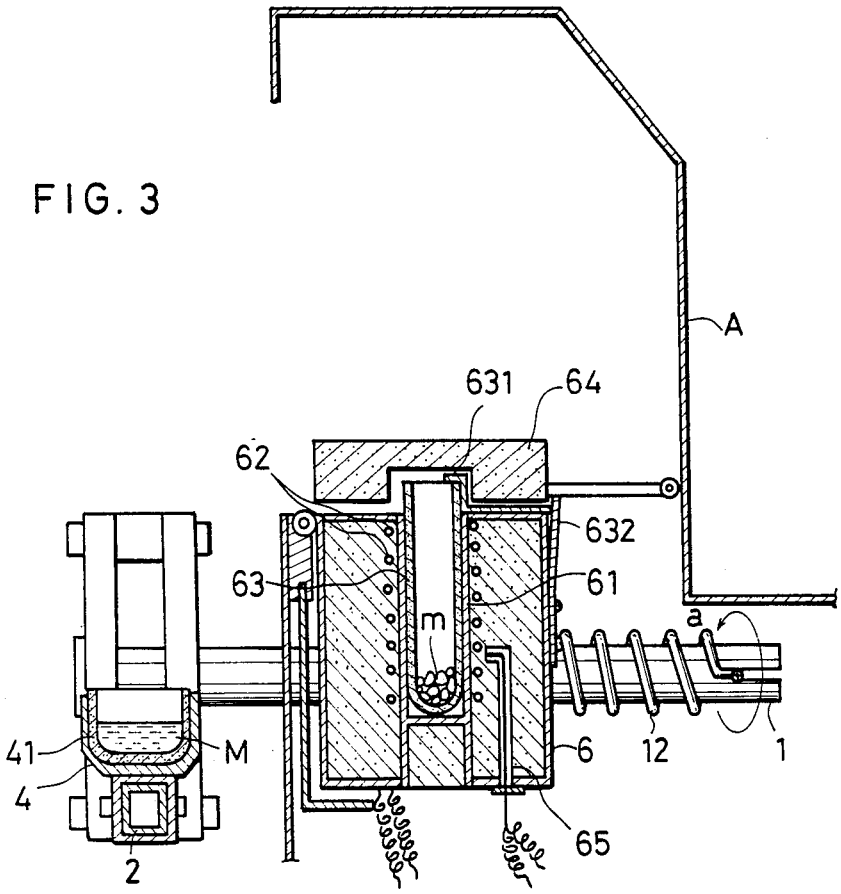
FIG. 3 is a longitudinal sectional view taken along the line III—III of FIG. 1.

As shown in FIGS. 1 to 6, the centrifugal casting device which can achieve the primary object of the invention comprises a rotary driving shaft 1, a rotary arm 2 mounted at the end of the shaft 1 and turning around the axis of the shaft 1 by the driving force of the shaft 1, a balance weight 3 adjustably mounted at one end side of the arm 2 along the axial direction thereof, a crucible holding means 4 disposed at the other end of the arm 2 for holding a casting crucible 41 adapted to receive a melting material for casting therein, a mold holding means 5 connected to the centrifuging side of the crucible holding means 4, and a casting material melting means 6 mounted so as to lie outside the path of rotation of the arm 2 at least when the rotary arm 2 is rotated.

In FIG. 1, the character A designates a casing for storing therein a driving means for rotating the rotary arm 2 and a casing for storing therein apparatuses related with a control system and the like system; B a control panel; and C designates a safety cover hinged to the side of the casing A and adapted to cover rotating parts when the device is operated. The rotary arm 2 is attached in T-shape to the end of the driving shaft 1. The shaft 1 is rotated around the axis of the shaft 1 by driving force of an electric motor (not shown) mounted in the casing A or by the resilient force of a spring 12 (see FIG. 3) fitted around the shaft 1.

FIGS. 1 to 4 show an example of the melting furnace as a casting material melting means 6 placed nearest to the crucible holder 4 that is at rest. The melting material M heat melted in the melting furnace 6 is shifted into a casting crucible 41 by the melting furnace being tilted, and is poured into a mold 51 by rotation of the rotary arm 2 and cast therein as described above. The casting crucible 41 is shaped like a wooden shoe and receives the melting material M melted in the furnace 6 and is formed with a minute passageway 411 communicating with a cavity 511 of the mold 51 on the centrifuging side of the furnace. The melting furnace 6 comprises a heat-resisting core tube 61 and a heating element 62 wound around the tube 61, and is disposed in the casing A so as to be tiltable to the crucible holder 4 side. A fingerstall-shaped melting crucible 63 is inserted into the core tube 61 and a melting material (an ingot) m is melted in the crucible 63. The numeral 64 designates a cover over the upper opening of the crucible 63, and the cover is designed to be opened in interlocking relation with the tilted furnace 6. The numeral 631 designates a crucible keep plate designed to engage with an opening edge of the crucible 63 and the plate 631 functions to prevent the crucible 63 from being drawn out of the core tube 61 even when the furnace 6 is tilted by the resilience of a leaf spring 632. The numeral 65 designates a thermocouple for detecting the temperature in the furnace 6 and connected to a temperature control apparatus in a control panel B. The driving shaft 1 has a coil spring means 12 fitted therearound. The spring being charged as by an electric motor (not shown) and the like, the rotary arm 2 is turned in the direction of arrow a by the recoil strength of the spring means 12.

A series of operations of the construction members above are programmed in the control panel B and are automatically conducted by manipulation of buttons on the surface of the panel B. Procedures for this operation are briefly described in FIG. 4*a* to 4*d*.

In FIG. 4*a*, a casting crucible 41 is set on a crucible holding means 4 and a mold 51 is set on a mold holding means 5 and a start button on the control panel B is pressed. Thereupon, a melting furnace 6 is brought into a preheated state.

In FIG. 4*b*, pressing of a second operation button of the panel B (for example, a named a crucible key) opens a cover 64 and tilts the furnace 6 at an angle of about 45°, so that a melting crucible 63 having a casting material m therein is inserted into a core tube 61 of the furnace 6. Then, pressing of the second operation button once more restores the furnace 6 and the cover 64 to their original positions, and sets the furnace to a melting temperature and charges a coil spring means 12.

Figure 4:
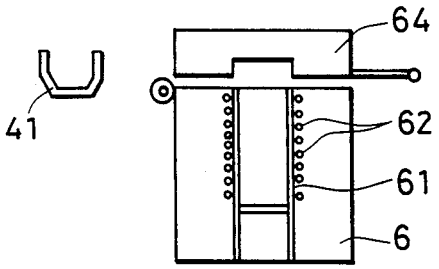
FIGS. 4*a,b, c* and *d* diagrammaticaly show in progressive steps respectively how melting and casting are effected by the use of the device of the invention.
Figure 4:
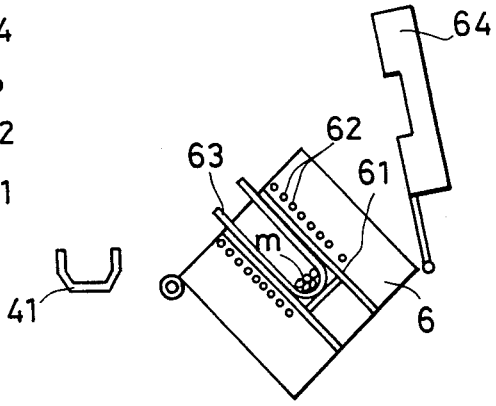
Figure 4C:
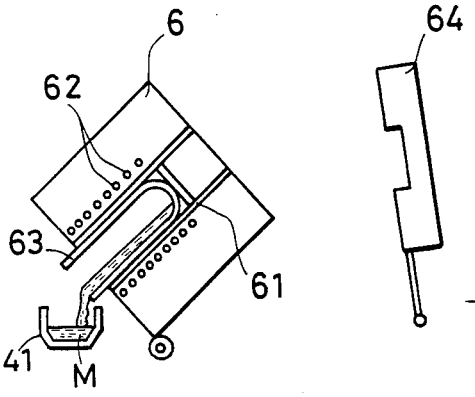

In FIG. 4*c*, pressing of a third operation button (for example, a casting key) on the panel B after having covered a front rotary portion with a cover C tilts the furnace 6 at an angle of about 135°, and pours the melting material M into the crucible 41 and then restores the furnace 6 to its original position.

Figure 4D:
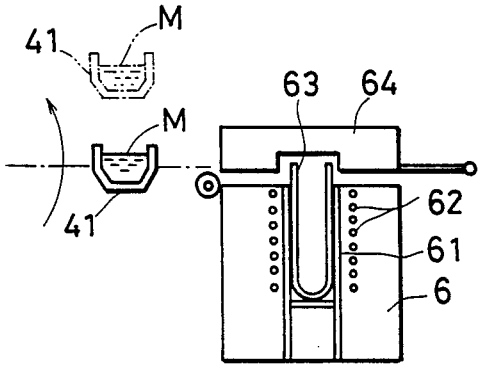

In FIG. 4*d*, immediately after the furnace 6 returns outside the path of rotation of the rotary arm 2, the arm 2 is rotated to effect molding. After the molding is over, the arm stops at the initial position, and returns to the state in FIG. 4*a* (wherein the return may conveniently be warned as by a buzzer). Accordingly, another batch of molding can be started by the above operation.

In this manner, rotation of the arm 2 around the axis of the driving shaft 1 pours the melting material M in the crucible 41 into the mold 51 by centrifugal force and starts casting. At this time, a balance weight 3 is suitably shifted axially of the arm 2 to adjust balance relative to the weight of the members on the casting side (crucible 41, mold 51, etc.). Accordingly, since load applied to the arm 2 is only that of the members on the casting side and of the balance weight 3, a small amount of power serves the purpose of output for the drive source for driving the members and balance weight, and the arm can attain the required speed of rotation as soon as they start rotation, so that casting is performed efficiently. Also, since heat melting of the casting manerial is carried out by the furnace 6, a suitable combination of a temperature detecting means and control means with the furnace 6 could readily provide proper temperature setting according to each casting material.

As described above, the series of operations are carried out by button manipulation and a small amount of power, so that the device can be provided in compact form, and hence installation of the device as at a dental office is highly useful in point of space. Furthermore, preprogramming a melting temperature or staying time of a melt in the furnace in accordance with the kind of casting material makes it easy for the operator to conduct a series of operations from melting to casting at a simple button operation.

Figure 5:
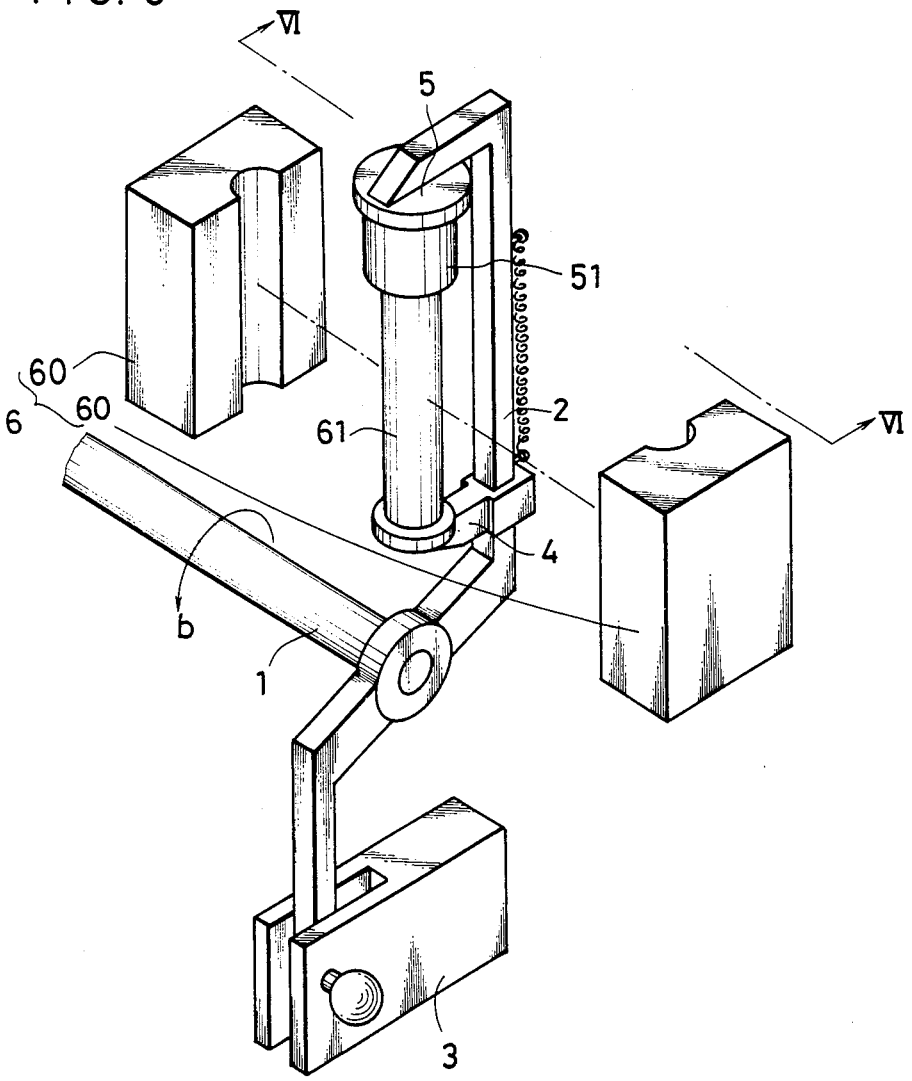
FIG. 5 is an exploded perspective view of the essential part of another embodiment of the invention.
Figure 6:
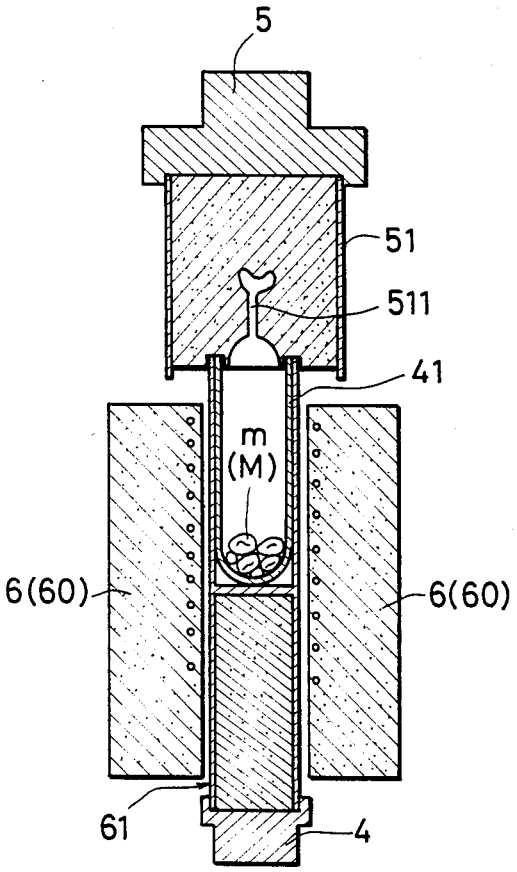
FIG. 6 is a longitudinal sectional view taken along the line VI—VI of FIG. 5.
Figure 7:
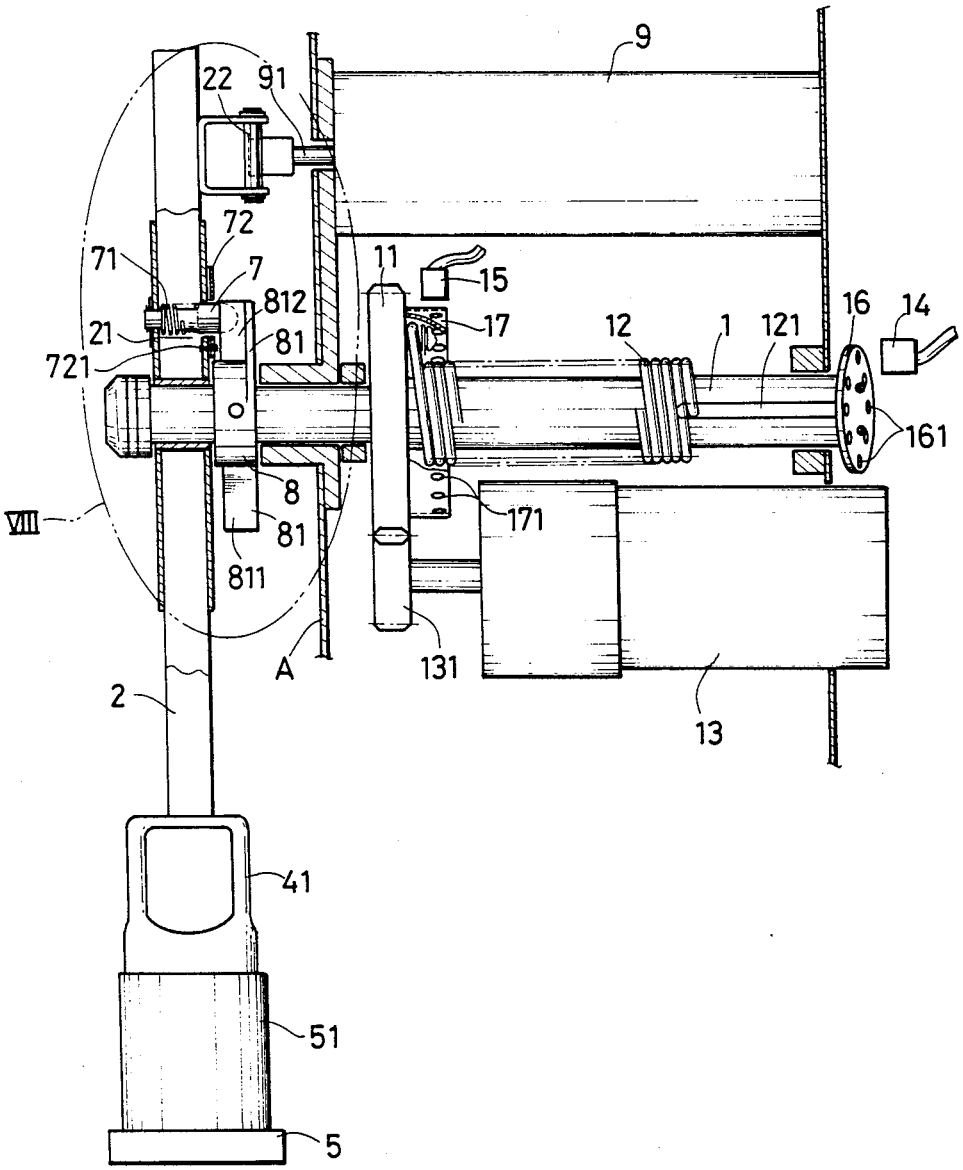
FIG. 7 is a plan view, partly broken, showing a rotating mechanism of an arm in FIG. 1 with a sensor plate 16 being intentionally inclined with respect to the axis of a rotary driving shaft 1 for easier understanding.
Figure 8:
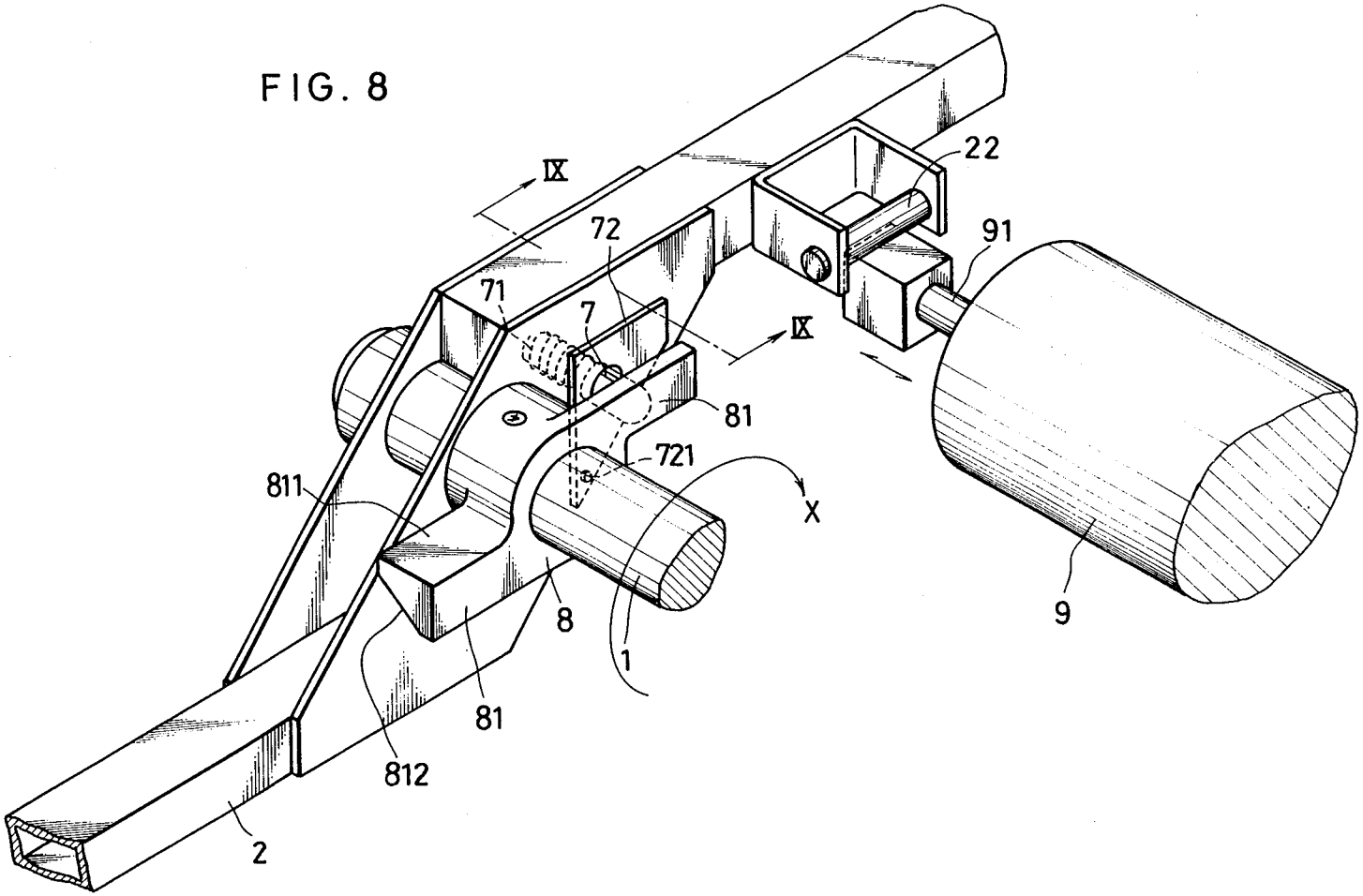
FIG. 8 is a perspective view of the line VIII FIG. 7.
Figure 9:
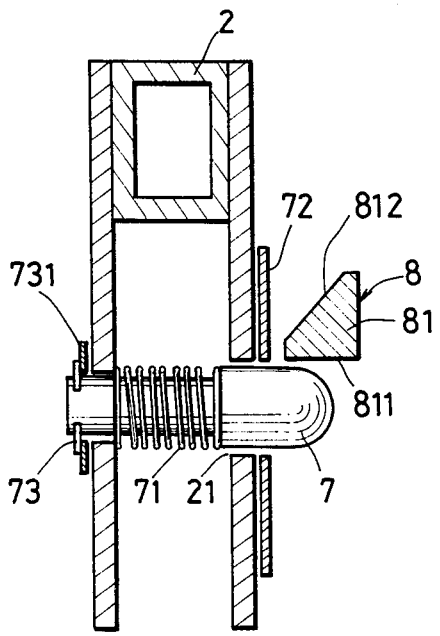
FIG. 9 is an enlarged sectional view taken along the line IX—IX of FIG. 8.

FIGS. 5 and 6 show that the furnace 6 is a split type furnace consisting of two units 60 and 60, wherein the rotary rm 2 is disposed vertically in a halted state, and a core tube 61 having a fingerstall-shaped melting crucible 41 inserted thereinto and a mold 51 are fixed along the arm 2 by a crucible holding means 4 and a mold holding means 5, the core tube 61 being encircling by the split type units 60 and 60 to melt the casting material m in the crucible 41. At the point of time that the casting material m has been melted, splitting the furnace 6 apart, moving the furnace (retreating the furnace 6 outside the path of rotation of the arm 2), and rotating the arm 2 in the direction of arrow b pour the material M(m) in the crucible 41 into the mold 51 by centrifugal force from its opening through the cavity 511, wherein the melting material M is cast. Other members are like the above and further their series of operations can be likewise automatically preprogrammed by button operation with respect to various control apparatuses disposed inside the control panel.

Incidentally, the use of a platinum alloy as a heating element for the furnace 6 is most suited.

As shown in FIGS. 7 to 10*a* and 10*b*, the centrifugal casting device which can achieve the second object of the invention further comprises the means for driving the rotary arm 2 which includes a coil spring means 12 fitted around the driving shaft 1 and secured at one end to the shaft 1 and fixed at the other end to a driving wheel 11 fitted around the shaft 1 rotatably relative to the shaft 1; a drive source 13 connected to the driving wheel 11 for urging the coil spring means 12 in the direction of its winding; a clutch pin 7 resiliently mounted in parallel to the driving shaft 1 by a compression spring 71 so as to be freely movable in and out of the rotary arm 2; a clutch member 8 fixed to the shaft 1 in position nearest to the arm 2, and which, in the direction of rotation of the shaft 1, is adapted to come into contact with the periphery of the the clutch pin 7 and to bring the shaft and the arm 2 into cooperative rotation, but which, in the opposite direction of rotation, is adapted to retreat the clutch pin 7 to slide over the top of the pin; a stopper 9 for stopping the rotary arm 2 in normal position; a first sensor 14 for detecting the position of rotation of the shaft 1 and setting the zero level of the arm 2; and a second sensor 15 for detecting the rotated position of the driving wheel 11.

The clutch member 8 is formed with pawls 81 extending symmetrically centrifugally relative to the center of rotation of the member 8. One surface of each pawl 81 is made a flat cam face 811 so as to make cooperative rotation with the arm 2 when it comes in contact with the clutch pin 7, while the other surface is made an inclined cam face 812. When the cam face 812 comes in contact with the clutch pin 7, the face 812 retreats the pin 7 and slides over the top of the pin to make it possible for the arm 2 to rotate relative to the clutch member 8 without being regulated by the member 8.

Figure 10:
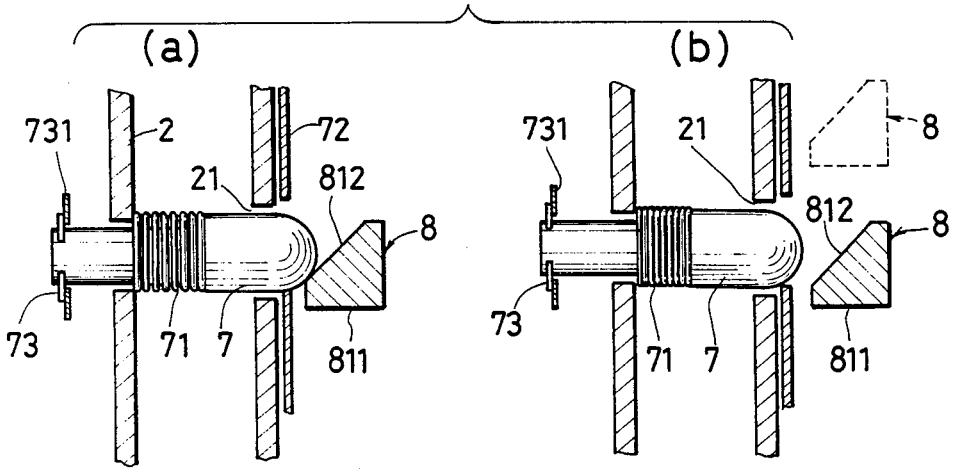
FIGS. 10*a* and 10*b* are an explanatory view showing the state of operation of a clutch pin used in the invention.

The clutch pin 7 is made of a columnar member and is resiliently inserted by a compression spring 71 into the hole 21 formed in the base of the arm 2 in the manner that the pin 7 is freely moved in and out of the hole 21. The top of the pin 7 is made semispherical so as to impart smooth slide to the face 812 when the inclined cam face 812 comes into contact with the spherical top of the pin 7. In FIG. 10, the numeral 731 designates a buffer member made of felt or rubber for softening an impulsive sound produced between the arm 2 and an E-ring 73 when the clutch pin 7 is reciprocated within the hole 21.

A governor plate 72 is rotatably journalled on a shaft 721 on the base of the arm 2 near the clutch pin 7 and when the arm 2 is rotated for casting at high speed, the governor plate 72 is designed to swing centrifugally by centrifugal force with the shaft 721 as a fulcrum and along the base of the arm 2. When the arm 2 is brought into high speed rotation by being relieved of control of the stopper 9 and the clutch pin 7 is retreated into the hole 21 by the action of the inclined cam face 812, the governor plate 72, as described above, is shifted by centrifugal force, engaged with the top of the clutch pin 7 tending to project again, and functions to prevent the pin 7 from projecting.

A coil spring means 12 is fitted around the shaft 1 in such a manner that one end of the spring means 12 is caught by the slit 121 formed at the base end of the shaft 1 and the other end of the spring 12 is fixed to the driving wheel 11. The coil spring means 12 is engaged in the slit 121 in such a manner as to slide axially of the shaft 1 and not to rotate circumferentially of the shaft. A sensor plate 16 is fixed to the base end of the shaft 1, the plate 16 being circumferentially formed with a multiplicity of through-holes 161 so as to make it possible to detect the rotated position of the shaft 1 in combination with the first sensor 14. Furthermore, a sensor ring 17 having a multiplicity of through-holes 171 circumferentially formed therein is fixed coaxially with the driving wheel 11 to the side of the wheel 11 so as to make it possible to detect the rotated position of the driving wheel 11, i.e. a degree of charge of the coil spring 12 in combination with a second sensor 15.

The driving wheel 11 is shown in the form of a wheel gear in the embodiment illustrated and is connected through a pinion gear 131 to a brake-fitted electric motor used as a drive source 13 , and the rotary arm 2 is set in normal horizontal position or the coil spring 12 is charged in the direction of its winding by the driving force of the motor 13. The connected relation between the driving wheel 11 and the drive source 13 is not limited to the embodiment illustrated but gearing such as a timing belt or chain may also be used.

In the embodiment illustrated, a push-pull plunger disposed in parallel to the driving shaft 1 is used as a stopper 9. In the plunger 9, an electromagnetically-actuated mechanism is operated by an external signal (on-off signal controlled by the control apparatus in the control panel B) and a rod piston 91 is expanded and contracted in parallel to the shaft 1 in such a manner that when the piston 9 is expanded , it extends inside the path of rotation of the rotary arm 2 to prevent the rotation of the arm. A stop rod 22 is fixed to that position of the arm 2 corresponding to the piston 91 and substantially this rod 22 bears against the expanded piston 91 to prevent rotation of the arm 2 and hold the arm in normal horizontal position for a casting preparatory step.

A description will be given of how the device of the invention constructed in the manner described is operated.

(1) Preparatory step before casting:

When the rotary arm 2 is not in normal horizontal position ( a position in which a molten casting material is poured into the casting crucible 41 by tilting a melting furnace 6) , the push-pull plunger 9 is expanded to operate the electric motor 13 and to rotate the wheel gear 11 in the direction of arrow X. At this time, the power of the gear 11 is transmitted to the driving shaft 1 by the coil spring means 12 to rotate the shaft 1 in the same direction, whereupon the clutch member 8 is also rotated to bring the flat cam face 811 of the pawl 81 into contact with the clutch pin 7 to rotate arm 2. The rotary arm 2 turns round the axis of the shaft 1 to bring the stop rod 22 into abutment with the piston 91 of the push-pull plunger 9 to stop the rotation of the arm 2. At this time, a first sensor 14 detects the stop position and recognizes zero level. In this state, rotation of the arm 2 in the above described direction of X is completely prevented but the arm is instable in a direction opposite thereto and accordingly, the instabilized arm 2 inconveniences the subsequent setting of the casting mold 51. Accordingly, when the wheel gear 11 is rotated in the direction of arrow X by further rotating the motor 13, the coil spring means 12 is slightly charged in the direction of its winding because the shaft 1 is made unable to rotate by the action of the clutch member 8 and clutch pin 7. The arm 2 is, therefore, stabilized in both positive and negative directions by stored resilience of the spring means 12. The position of the arm 2 which brings about this stabilized state of the arm 2 is detected and stored by a second sensor 15 and the wheel gear 11 is rotated by driving the motor 13 to charge the coil spring 12. Difference between the detected position by the sensor 15 in this state and the zero level detected by the sensor 14 provides that amount of charge of coil spring means which corresponds to the force of rotation in time of casting and which is properly determined depending on the properties or amount of the material to be cast. Because the coil spring means 12 is subjected to fatigue by effect of time, mere mechanical charging of the spring 12 changes the amount of charge of spring means, resulting in the difference of force of rotation of the rotary arm 2. In the invention, since zero level is detected by the first sensor 14 and the amount of charge of the spring means 12 is detected by the second sensor 15, a programming of predetermined amount of spring charge makes it possible for the motor 13 to operate in accordance with the amount and always provides a constant amount of charge, namely, a predetermined force of rotation of the rotary arm 2.

(2) Pouring of casting material and setting of a mold:

The casting crucible 41 and the mold 51 are set in specified positions of the rotary arm 2, and the casting material premelted in the melting furnace 6 is poured into the crucible 41 by tilting the furnace 6. Since preparations for casting are completed by the above operation, the following steps are immediately taken.

(3) Casting:

In the aforestated state, the stored resilience of the charged coil spring means 12 is imparted to the arm 2 in which the force of rotation is prevented by the push-pull plunger 9 at the clutch pin 7 concentratedly in the direction of arrow X. Accordingly, contraction of piston 91 of the plunger 9 lifts this control and the arm 2 starts rotation rapidly in the direction of arrow X to reach a speed of about 1000 rpm momentarily so that the melting material in the crucible 41 is poured by centrifugal force into the mold 51 and cast. Because at this time the clutch member 8 is at rest, the clutch pin 7 comes in contact with the inclined cam face 812 opposite to the contacting face (i.e. flat cam face 811) of the clutch member 8 in accordance with the rotation of the arm 2 (see FIG. 10*a*), but because the cam face 812 is inclined, the clutch pin 7 is retreated against the action of the compression spring 71 into a hole 21 by component of force at the time of its contact with the cam face 812, to thereby make the arm 2 continue rotating as it is. When the governor plate 72 disposed near the clutch pin 7 swings centrifugally by centrifugal force and the clutch pin 7 is retreated as described above, the governor plate 72 is engaged with the top of the clutch pin 7 and prevents projection of the pin (see FIG. 10*b*). Accordingly, the clutch member 8 thereafter keeps rotating without striking against the clutch pin 7 (actually, the clutch pin 7 rotates). In this manner, casting is completed in 10 to 20 minutes, and at the same time, the speed of rotation of the arm 2 is reduced under the resistance of other structural members, whereupon centrifugal force applied to the governor plate 72 is also reduced and at a certain point of time the plate 72 is returned to its original position. Then, engagement of the governor plate 72 with the clutch pin 7 is released, with the result that the pin 7 again projects by the resilience of compression spring 71, and rotates while striking against the clutch member 8 intermittently. Such governor plate 72 is preferably employed, because the plate 72 functions to reduce resistance to the rotary arm 2 in time of casting as much as possible to thereby keep proper speed of rotation and to prevent disagreeable sound of the the clutch member 8 striking against the clutch pin 7 and also functions to reduce the speed of rotation of the arm 2 as soon as possible by contact resistance between the clutch pin 7 and the clutch member 8 at the end of casting. But it is to be understood that the structure described is not limited to the embodiment illustrated and various other modifications and amendments may be possible.

Since in this manner a series of casting operations are completed and the arm 2 stops at any given position, starting of operation from the step in Item (1) above repeats the same casting operation efficiently when the succeeding casting is continued.

The above series of operations can be programmed as one cycle of operation by control apparatuses incorporated into the control panel B and can be automatically performed by manipulation of buttons. Needless to say, it is possible to set the rotary arm 2 in normal horizontal position and to program the position as a starting position.

Incidentally, it should be understood that the invention is not limited to the embodiments illustrated and that for example, the first and second sensors 14 and 15 or the stopper 9 and also the drive source 13 may be provided in other modifications.

As described above, firstly, in the centrifugal casting device of the invention, not only setting of proper melting temperature is greatly facilitated in that the casting material melting means which makes it possible to regulate temperature and provide the device in compact form is used for melting a casting material but also a series of operations from melting to casting can automatically be performed by programming the operations beforehand. In casting, the melting means is positioned outside the path of rotation of the rotary arm so that the melting means does not take part in the casting, with the result that load applied to the rotary arm and to the drive source for the arm is small. Accordingly, the whole of the device can be made very compact in construction. In addition, the fact that the load applied to the rotary arm is small due to nonrotation of the melting means provides the advantage that the rotary arm, for example, quickly attains the required speed of rotation desirable for casting and renders it possible to make rapid and efficient centrifugal casting.

In addition to the above advantage, secondly, the invention makes it possible to set the rotary arm automatically and rapidly in normal position for making preparations for casting and to reduce the speed of rotation of the arm rapidly by the action of the clutch pin and clutch member after casting is over, thus reducing intervals beteen the succeeding operations to provide highly efficient casting operations even when it is desired to perform a multiplicity of casting operations. Since the invention includes sensors for detecting the respective positions of rotation of the driving shaft and driving wheel, the invention is enabled to invariably properly set the zero level of the rotary arm and obtain the predetermined amount of charge of the coil spring means with good reproducibility by a combination of signals from both sensors in spite of fatigue produced by effect of time in the coil spring means.

In addition thereto, the invention not only makes it possible to automtically control a series of operations of the inventive device inclusive of temperature control and tilting mechanism of a melting means for melting a casting material but also provides the advantage of automatizing by manipulation of buttons all the operations except for setting of a mold.

I claim:

1. A centrifugal casting device comprising a rotary driving shaft, a rotary arm mounted at an end of said shaft and turning around an axis of the shaft by driving force of the shaft, a balance weight adjustably mounted at a first end side of the arm along an axial direction thereof, means for holding a crucible disposed at a second end of the arm for holding a casting crucible adapted to receive a melted material for casting therein, means for holding a mold connected to a centrifugal side of said means for holding a crucible, and means for melting casting material movably mounted so as to permit pouring of said melted material from said means for melting casting material into said casting crucible when said rotary arm is in an initial position and withdrawing of said means for melting casting material to a second position so as to lie outside a path of rotation of the arm at least when the rotary arm is rotated.

2. A centrifugal casting device according to claim 1 wherein means for melting casting material includes a detachable melting crucible inside the means for melting casting material.

3. A centrifugal casting device according to claim 1 wherein said melting means is designed to be a detachable split type melting means encircling said crucible holding means and a casting material is heated to melt by said melting means in the casting crucible held by the crucible holding means, and is cast by turning said rotary arm after having split said melting means and having retreated said melting means outside the path of rotation of the arm.

4. A centrifugal casting device comprising a rotary driving shaft, a rotary arm mounted at an end of said shaft and turning around an axis of the shaft by driving force of the shaft, a balance weight adjustably mounted at a first end of the arm along an axial direction thereof, means disposed at a second end of the arm for holding a casting crucible adapted to receive a melted material for casting therein, means for holding a mold connected to a centrifugal side of said means for holding a casting crucible, and means for melting casting material mounted so as to lie outside a path of rotation of the arm at least when the rotary arm is rotated, said device further comprising a means for driving said rotary arm which includes:

a coil spring means fitted around the driving shaft and secured at a first end to the shaft and fixed at a second end to a driving wheel fitted around the shaft rotatably relative to the shaft;

a drive source connected to the driving wheel for urging said coil spring means in a direction of winding thereof;

a clutch pin resiliently mounted in parallel to the driving shaft by a compression spring so as to be freely movable in and out of the rotary arm;

a clutch member fixed to the shaft in position nearest to the arm and which, in a direction of rotation of the shaft, is adapted to come into contact with said clutch pin and to bring the shaft and the arm into cooperative rotation, but which, in a direction opposite to that of rotation, is adapted to retreat the clutch pin and slide over a top end of the pin;

a stopper for stopping the rotary arm in normal position;

a first sensor for detecting position of rotation of the shaft and setting a zero level of the arm; and a second sensor for detecting rotated position of the driving wheel.

5. A centrifugal casting device according to claim 4 wherein said means for melting casting material includes a detachable melting crucible and is movably mounted so as to permit pouring of said melted material from said means for melting casting material into said casting crucible when said rotary arm is at said zero level and withdrawing of said means for melting casting material to a second position so as to lie outside the path of rotation of said rotary arm.

6. A centrifugal casting device according to claim 4 wherein said melting means is designed to be a detachable split type melting means encircling said crucible holding means and a casting material is heated to melt by said melting means in a casting crucible held by said crucible holding means, and is cast by turning said rotary arm after having split said melting means and having retreated said melting means outside the path of rotation of the arm.

7. A centrifugal casting device according to claim 4 wherein a governor plate slidably swinging along said rotary arm is mounted in the vicinity of said clutch pin, said plate being designed to be moved by the centrifugal force of said rotary arm to the centrifugal side thereof when the arm is rotated and to engage with said clutch pin to hold said pin in the retreated state thereof.

* * * * *